US006817581B1

(12) United States Patent
McAllister

(10) Patent No.: US 6,817,581 B1
(45) Date of Patent: Nov. 16, 2004

(54) BAG HANGING AND STORAGE DEVICE

(75) Inventor: Robert J. McAllister, Solana Beach, CA (US)

(73) Assignee: McAllister Products, Inc., Solana Beach, CA (US)

( * ) Notice: Subject to any disclaimer, the term of this patent is extended or adjusted under 35 U.S.C. 154(b) by 0 days.

(21) Appl. No.: 10/725,922

(22) Filed: Dec. 1, 2003

Related U.S. Application Data

(63) Continuation-in-part of application No. 10/427,240, filed on Apr. 30, 2003, now Pat. No. 6,666,416.

(51) Int. Cl.[7] ..... B65B 67/04
(52) U.S. Cl. ..... 248/95; 248/99
(58) Field of Search ..... 248/95, 99, 100, 248/97, 130, 145, 311.2, 316.8, 907; 383/33, 34

(56) References Cited

U.S. PATENT DOCUMENTS

| | | | | | |
|---|---|---|---|---|---|
| 3,374,976 | A | | 3/1968 | Kurlander et al. | |
| 4,062,604 | A | | 12/1977 | Popper | |
| 4,548,542 | A | * | 10/1985 | Reese | 414/549 |
| 4,749,158 | A | * | 6/1988 | Buckley | 248/98 |
| 4,846,427 | A | | 7/1989 | Jones | |
| 4,881,706 | A | | 11/1989 | Sedlik | |
| 4,921,197 | A | * | 5/1990 | Benoit et al. | 248/97 |
| 4,998,694 | A | | 3/1991 | Barteaux | |
| 5,005,791 | A | | 4/1991 | Lanzen | |
| 5,289,957 | A | * | 3/1994 | Huang | 224/550 |
| 5,360,189 | A | | 11/1994 | Hart | |
| 5,503,355 | A | | 4/1996 | Tan | |
| 5,884,556 | A | * | 3/1999 | Klepacki et al. | 100/349 |
| 6,003,820 | A | * | 12/1999 | Baldonado et al. | 248/99 |
| 6,042,063 | A | | 3/2000 | Kerr et al. | |
| 6,116,549 | A | * | 9/2000 | Santa Cruz et al. | 248/97 |
| 6,152,408 | A | | 11/2000 | O'Grady | |
| 6,155,521 | A | | 12/2000 | O'Hanlon | |
| 6,202,922 | B1 | * | 3/2001 | Phillips et al. | 232/43.1 |
| 6,330,990 | B1 | | 12/2001 | Haubrich | |
| 6,382,573 | B1 | | 5/2002 | Cepeda | |
| 6,460,814 | B1 | | 10/2002 | Bolick | |
| 6,488,241 | B1 | | 12/2002 | Kyte et al. | |
| 6,598,898 | B2 | | 7/2003 | Chu | |
| 6,666,416 | B1 | * | 12/2003 | McAllister | 248/95 |

* cited by examiner

*Primary Examiner*—Anita King
*Assistant Examiner*—Tan Le
(74) *Attorney, Agent, or Firm*—The Maxham Firm

(57) ABSTRACT

A bag storage and holding apparatus for a recyclable or disposable handle bag. The apparatus has a receptacle for storing handle bags for future use and in some embodiments it has a cover over the open top portion of the receptacle. The cover can be opened or closed. On each end of the receptacle is a rotatably mounted side arm, which can swing up or down through approximately 90 degrees. When the arms are in an approximately horizontal position, the apparatus is positioned for receiving a handle bag and maintaining it in an open position. Securing means, in the form of a locking tab, are provided to secure the side arms in an upward position. Each side arm has handle engaging means, preferably in the form of at least two upwardly projecting hooks with slots therein for retaining the bag in an open position for receipt of refuse.

24 Claims, 5 Drawing Sheets

BAG HANGING AND STORAGE DEVICE

CROSS-REFERENCE TO RELATED APPLICATION

This is a continuation-in-part of U.S. patent application Ser. No. 10/427,240, which was filed on Apr. 30, 2003 now U.S. Pat. No. 6,666,416.

BACKGROUND OF THE INVENTION

1. Field of the Invention

The present invention relates generally to bag hanging and storage devices, and more particularly to an apparatus for storing and hanging handle bags and the like for receiving refuse.

2. Discussion of the Related Art

There are various devices for holding handle bags open for the purpose of receiving refuse. Some of these devices stand on a flat surface, while others are mounted on a vertical surface. However, one common aspect is that the bag is held open so that refuse can be deposited inside.

Several of the known devices also have hinged or collapsible arms for holding the open bag. These arms may be notched or grooved for placement and holding of the handle. The arms can be folded inward for storage of the device when not in use. This is particularly advantageous where the device is mounted on the inside of a cabinet door, for example.

However, no known device also provides for sufficient storage of bags when not in use. In this regard, the present invention substantially fulfills this need.

SUMMARY OF THE INVENTION

The present invention provides a bag holding and storage apparatus for retaining a recyclable or disposable handle bag, which bag may be of the type referred to as "plastic" in retail stores. It provides a means to store bags when not in use and to conveniently access and position them in an open position for receiving refuse. The apparatus is preferably mounted in a convenient location, for example, on the inside of a cabinet door. When not in use, the arms of the apparatus can be folded down to minimize the space it occupies.

The apparatus has a receptacle shaped and configured to store a plurality of bags. In some embodiments, a cover or lid is provided on the receptacle and can be placed in an open or closed position. The receptacle has first and second ends and front and back sides. A first side arm member having a top surface is also provided. This member is rotatably connected at the first end of the receptacle and is capable of extending forward from the front side when in a receiving position and extending downward when in a stored position. A second side arm member having a top surface is provided. This member is rotatably connected at the second end of the receptacle and is capable of extending forward from the front side when in a receiving position and extending downward when in a stored position. Securing means are located on the first and second ends of the receptacle for securing the first side arm and the second side arm, respectively, in a receiving position. A bag handle engaging means on the top surface of each side arm member, is adapted to positively retain the handle of the bag, thereby holding the bag open for receipt of refuse.

In one embodiment, the bag handle engaging means includes hooks that project upward and preferably slightly away from the center of the apparatus. The hooks are formed on a longitudinal axis of the top surface of the side arm members and are configured to engage the handles of the bag and retain the bag in an open position. In a preferred embodiment, there are at least two hooks on the top surface of each side arm member.

In another embodiment, the bag handle engaging means have slots therein for receiving a bag handle. In a further preferred embodiment, each slot has semi-spherical bumps therein to further aid in retaining the bag handle. The two slots on each side arm member form a central section therebetween. The slots are particularly adapted to positively retain the handle of the bag in a manner holding the bag open for receipt of refuse.

In the embodiments disclosed herein, the side arm members are rotatable through approximately 90 degrees so that they are movable between an approximately horizontal position and an approximately vertical position.

In the embodiments disclosed herein, the securing means further has a locking tab means. The locking tab means has a tab and a bulbous body portion so that, when in an engaged position, the body portion prevents rotation of the side arm, and when in a disengaged position, it allows rotation of the side arm.

BRIEF DESCRIPTION OF THE DRAWING

The objects, features and advantages of the invention will become more apparent to those skilled in the art after considering the following detailed description, when read in connection with the accompanying drawing, wherein.

DETAILED DESCRIPTION OF THE PREFERRED EMBODIMENTS

Throughout this description, the embodiments and examples shown should be considered as exemplars, rather than as limitations on the present invention. In the following paragraphs, embodiments of the present invention will be described in detail by way of example with reference to the attached drawings.

Figure 1:
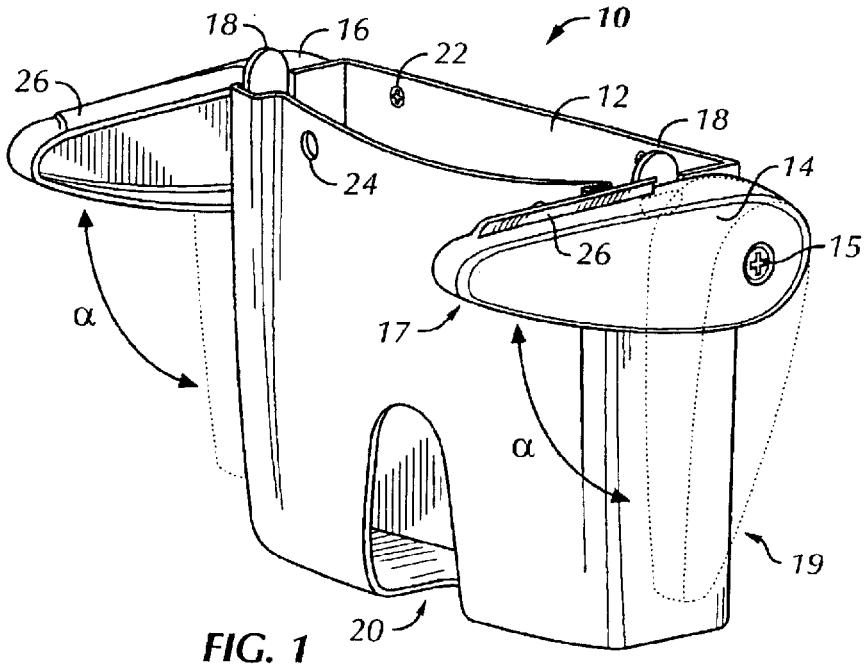
FIG. 1 is perspective view of an embodiment of the invention.
Figure 2:
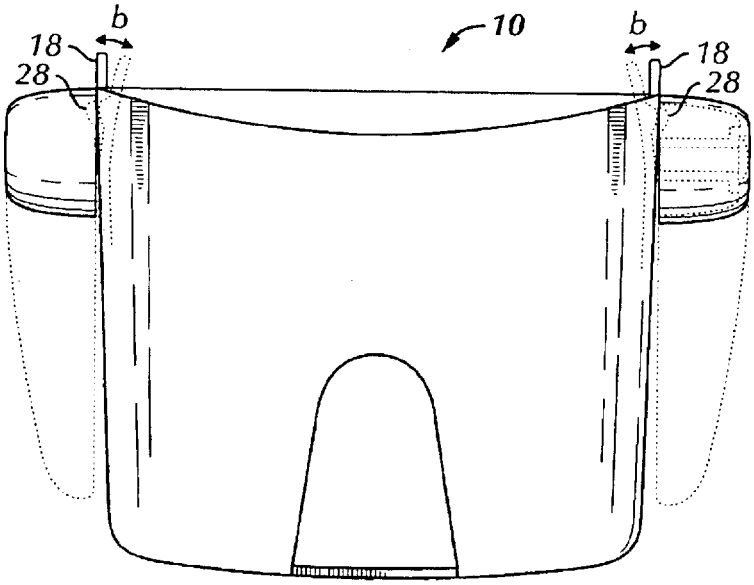
FIG. 2 is a front view of the embodiment shown in FIG. 1.

Referring to FIGS. 1 and 2, a bag storage and hanging device in accordance with one embodiment of the invention is illustrated and designated generally by the numeral 10. The device has receptacle 12 that is generally shaped and configured to store a plurality of bags when they are not in use. Those skilled in the art understand that the size of the receptacle may vary depending on various factors including the overall space to be occupied by the apparatus and also the number of bags to be stored. The receptacle also has means 22 for attachment to a solid support, for example, usually a vertical surface or the inside wall or door of a cabinet. Means 22 can be a screw, or other appropriate form of attachment well known to those skilled in the art. Hole 24 is provided on a front side of the receptacle, thereby allowing a screwdriver, for example, to be used to secure the receptacle to the support. Opening 20, which is near or at the bottom portion of the receptacle, serves as convenient means for access and withdrawal of bags from the receptacle. It is preferable to withdraw the bags from the bottom of the receptacle in this manner since they will be more likely withdrawn one at a time. If a bag is removed from the top of the receptacle, it is quite possible that more than one bag will come out at a time.

Receptacle 10 has a front and back, as well as a first end and a second end. First side arm member 14 is rotatably connected at the first end of the receptacle by pivot connection 15, which may be a bolt or dowel. Other well-known forms of connection are also contemplated herein. Member 14 is capable of extending forwardly from the front side to receiving position 17. It is also capable of extending downwardly to storage position 19 (indicated in dashed lines). The path of rotation of member 14 is indicated by arrow "a" in FIG. 1. Second side arm member 16 is rotatably connected at the second end of the receptacle and operates in a similar manner.

Securing means 18, located on the first and second ends of the receptacle, secures each side arm member in receiving position 17. In the embodiment shown in FIG. 1, the securing means is a locking tab, made up of a tab and a bulbous body portion, which when in an engaged position, prevents rotation of the side arms, and when in a disengaged position allows rotation of the side arm.

As shown in FIG. 2, by pressing securing means 18 away from the side arm, or toward the center of the receptacle, as shown by arrow "b," bulbous body portion 28 is withdrawn from an interior space or detent of the side arm, thereby allowing the side arm to rotate. Means 18 is tensioned so that in a relaxed state it is in an engaged position. Phantom lines adjacent to means 18 in FIG. 2 show the disengaged position of the securing means.

Side arm members 14 and 16 also have bag handle engaging means 26 on their top surfaces. The bag handle engaging means are adapted to positively retain the handle of the bag, thereby holding the bag open for the receipt of refuse. In the embodiment shown in FIG. 1, the bag handle engaging means is formed as raised lip 26 on a longitudinal axis of the top surface of side arm members 14 and 16. The lip extends upward and slightly away from the center of the apparatus, thereby being configured to engage the handles of the bag and retain the bag in an open position.

Figure 3:
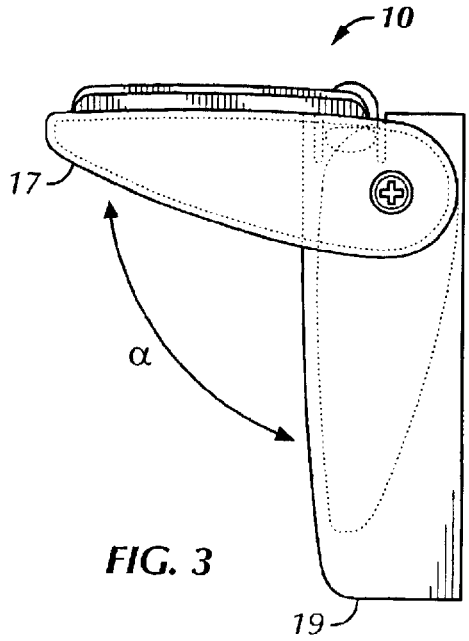
FIG. 3 is an end view of the embodiment shown in FIGS. 1 and 2.

FIG. 3 is an end view of the embodiments shown in FIGS. 1 and 2. Arrow "a" shows the movement of the side arm from engaged position 17 to disengaged position 19. When the side arm is in the disengaged position, it is generally flush with the front surface of the receptacle.

Figure 4:
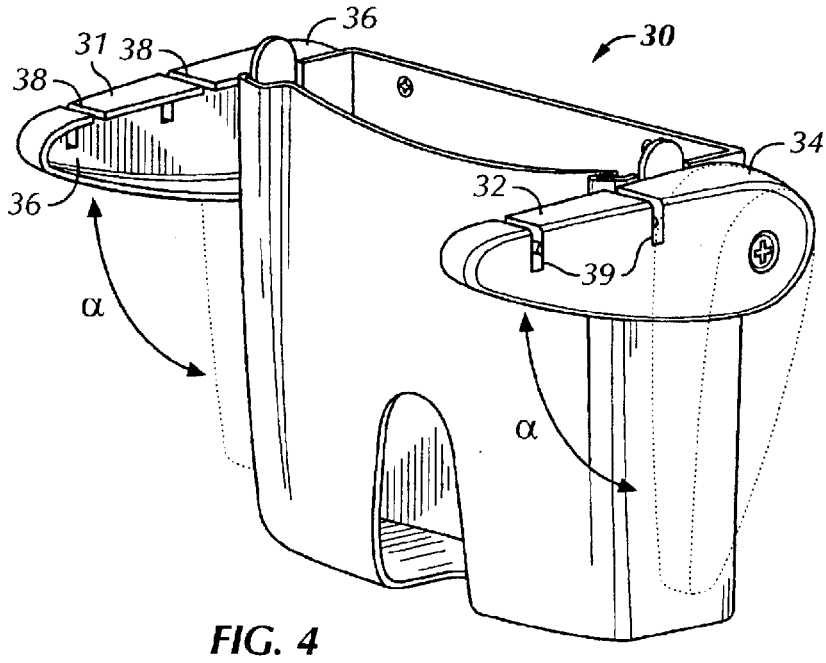
FIG. 4 is a perspective view of an alternate embodiment of the invention.

FIG. 4 is a perspective view of an alternate embodiment 30 of the present invention. Horizontal edges 31 and 32 of side arm members 33 and 34, respectively, have a pair of spaced notch means or grooves 38 and 39, respectively, formed therein in a spaced relationship. Notches 38 and 39 are dimensioned for receiving opposing sides of inverted U-shaped handles, which are disposed on opposing sides of a plastic grocery bag, for example. Thus, the bag is held open when the handle sides are inserted into the notches. In other respects, this embodiment 30 is similar in design and operation to previous embodiments. The spaced notch means form a central section therebetween in each side arm member. The notches are also adapted to positively retain the handle of the bag when the handle extends partially around the central section when looped from outside inwardly over the central section.

Figure 5:
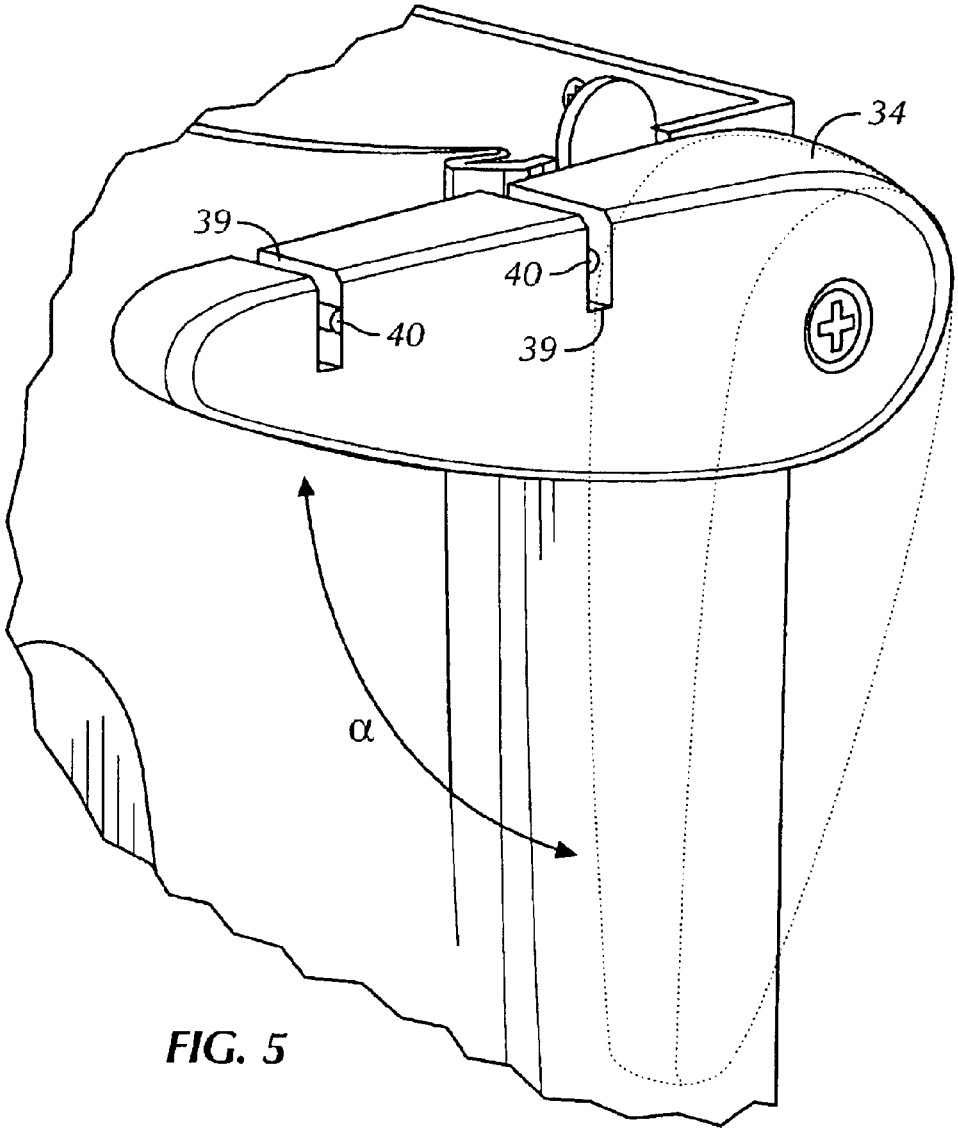
FIG. 5 is a detailed view of the handle securing means of the embodiment shown in FIG. 4.

FIG. 5 is a detailed view of the notches shown in the embodiment of FIG. 4. Formed within notches 39 are irregularities 40 to facilitate positive engagement of the handle. In one embodiment, the irregularities are bumps or semi-spherical ridges. These bumps or ridges may be arranged in an alternating fashion on opposite faces of the notches. Although only one is shown in each notch, there could be more than one ridge or bump, preferably two, in each notch. The ridges or bumps therefore serve to further secure the bag handle within the recesses and to prevent the handle from coming out of the notches unintentionally.

Figure 6:
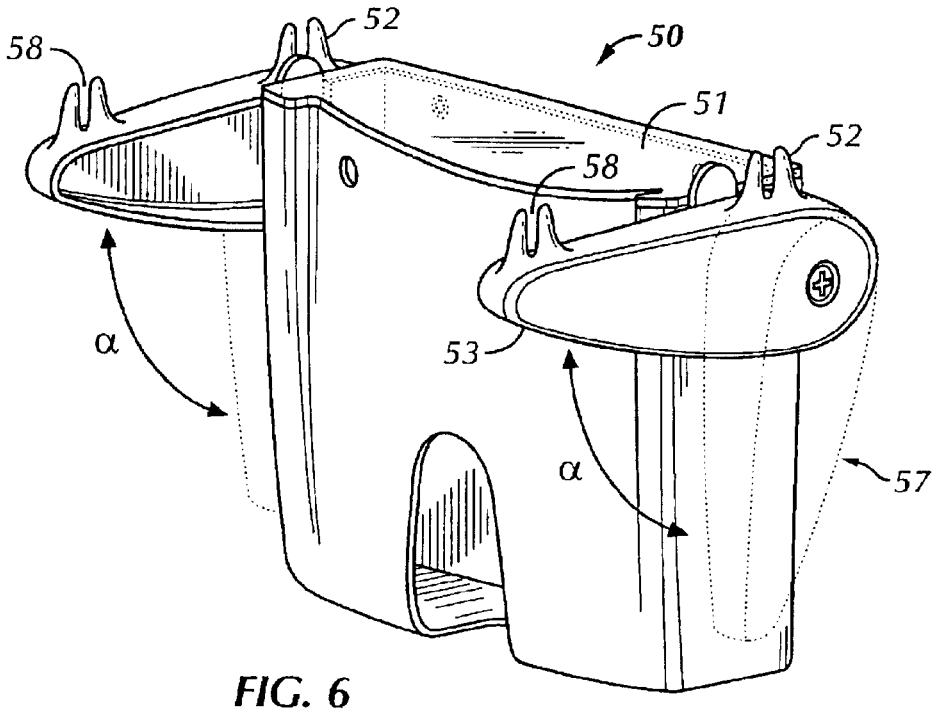
FIG. 6 is a perspective view of an additional embodiment of the invention.
Figure 7:
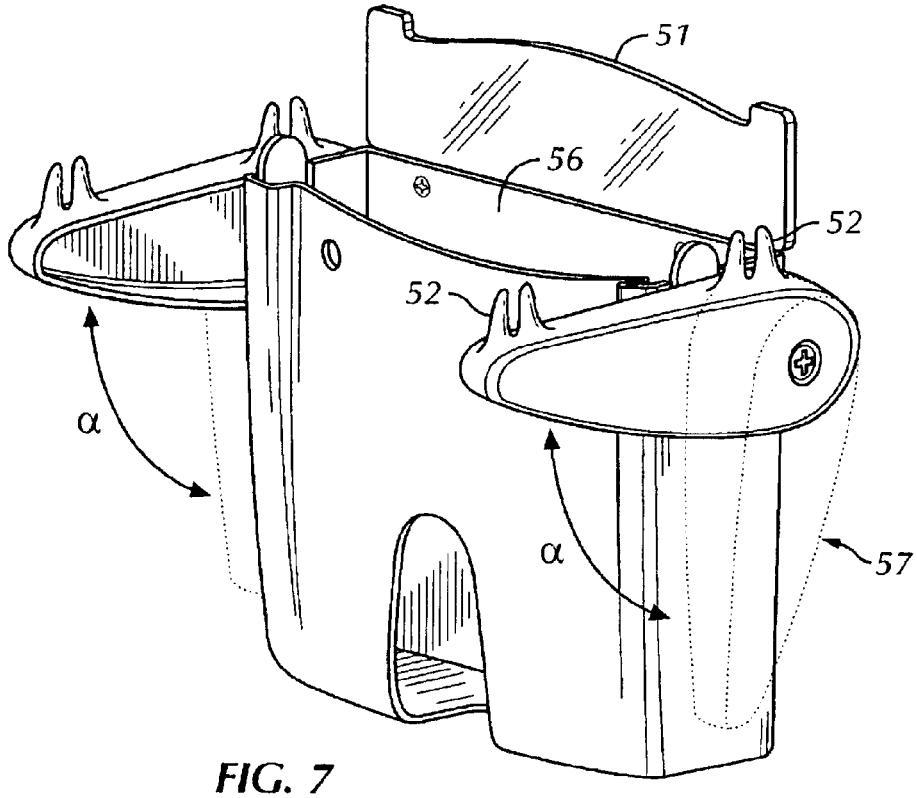
FIG. 7 is a perspective view of the embodiment shown in FIG. 6 with the cover in an open position.

Referring to FIGS. 6 and 7, a bag storage and hanging device in accordance with another embodiment of the invention is illustrated and designated generally by the reference numeral 50. As in the previous embodiments, the device has a receptacle that is generally shaped and configured to store a plurality of bags when they are not in use and an opening, which is near or at the bottom portion of the receptacle, to serve as convenient means for access and withdrawal of individual bags from the receptacle. It is preferable to withdraw the bags from the bottom of the receptacle in this manner since they will be more likely withdrawn one at a time. If a bag is removed from the top of the receptacle, it is quite possible that more than one bag will come out at a time.

As shown in FIGS. 6 and 7, the receptacle has cover or lid 51 over the opening of the receptacle. The cover serves to contain bags inside the receptacle during storage. The cover is preferably hinged and can be lifted up, as shown in FIG. 7, so that bags can be placed inside. In addition, the cover serves to prevent trash material from entering the receptacle when a bag is placed in a hanging position on the device.

Side arm member 53 is rotatably connected in the manner described in previous embodiments. Member 53 is capable of extending forwardly from the front side of the receptacle to a receiving position, which is approximately horizontal. It is also capable of extending downwardly to storage position 57 (indicated in dashed lines). The path of rotation of member 53 is indicated by arrow "a" in FIGS. 6 and 7. A second side arm member is rotatably connected at the second end of the receptacle and operates in a similar manner.

Securing means are located on the first and second ends of the receptacle, securing each side arm member in a receiving position. The securing means are substantially the same as in previous embodiments described herein.

Each side arm member also has bag handle engaging means 52 on its top surface. The bag handle engaging means are adapted to positively retain the handle of the bag, thereby holding the bag open for the receipt of refuse. In the embodiment shown in FIGS. 6 and 7, the bag handle engaging means is formed as upwardly projecting hooks on a longitudinal axis of the top surface of each side arm member. The hooks extend upward and preferably slightly away from the center of the apparatus, thereby being configured to engage the handles of the bag and retain the bag in an open position. In a preferred embodiment, the hooks have slots 58 formed therebetween.

Figure 8:
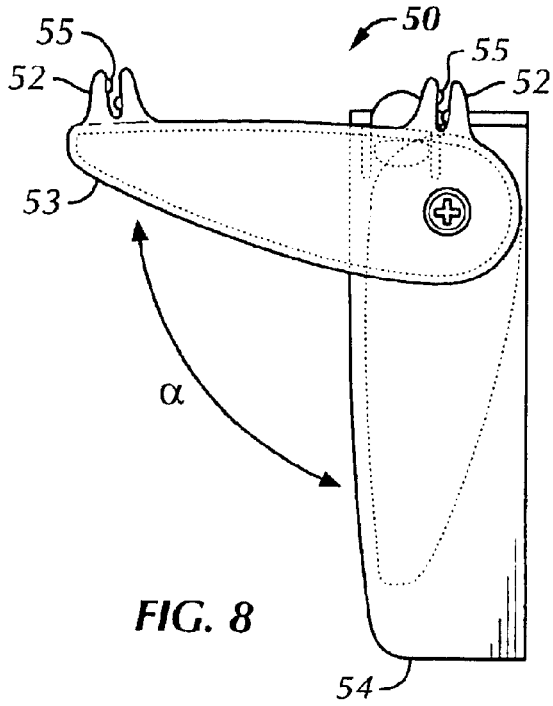
FIG. 8 is an end view of the embodiment shown in FIG. 6.

FIG. 8 is an end view of the embodiment shown in FIGS. 6 and 7. Arrow "a" shows the movement of the side arm from the engaged horizontal position to an approximately vertical disengaged position. When the side arm is in the disengaged position, it is generally flush with the front surface of receptacle 54.

Figure 9:
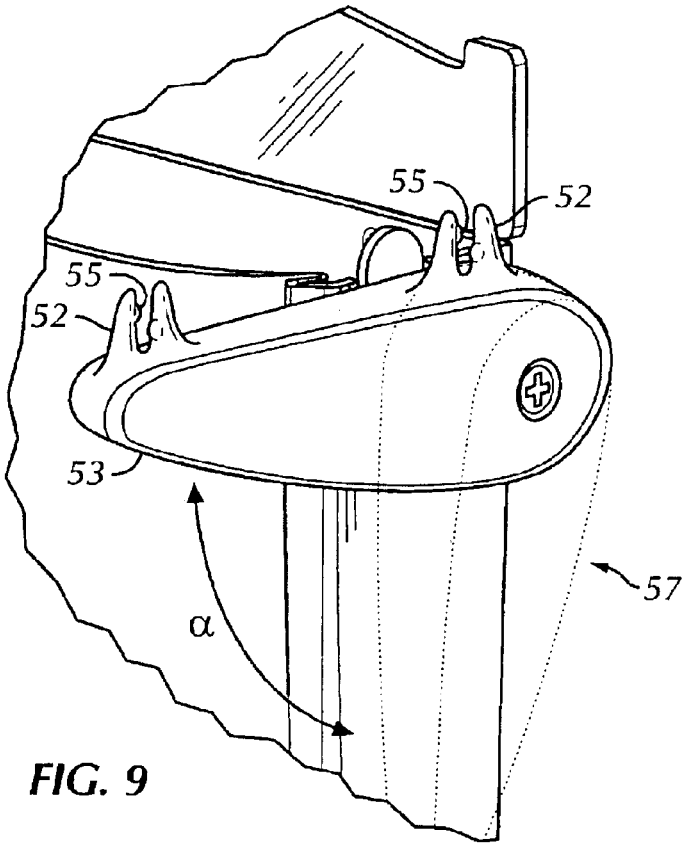
FIG. 9 is a detailed partial perspective view of the handle securing means of the embodiment shown in FIG. 7.

FIG. 9 is a detailed perspective view of the embodiment 50 of the present invention. As described above, each side arm member has a pair of spaced upwardly projecting hooks 52 formed therein in a spaced relationship. Slots are formed in hooks 52 for receiving opposing sides of inverted U-shaped handles, which are disposed on opposing sides of a plastic grocery bag, for example. Thus, the bag is held open when the handle sides are inserted into the slots. In other respects, this embodiment 50 is similar in design and operation to previous embodiments. On the top surface of each side arm member the spaced-apart hooks form a central section therebetween.

Formed within the slots are irregularities 55 to facilitate positive engagement of the bag handle. In one embodiment, the irregularities are bumps or semi-spherical ridges. These bumps or ridges may be arranged in an alternating fashion on opposite faces of the slots. The bumps therefore serve to further secure the bag handle within the hooks and to prevent the handle from coming out of the slots unintentionally.

Certain preferred embodiments have been described above. It is to be understood that a latitude of modification and substitution is intended in the foregoing disclosure, and that these modifications and substitutions are within the literal scope, or are equivalent to the claims that follow. Accordingly, the following claims should be construed broadly and in a manner consistent with the intent and scope of the invention herein described.

What is claimed is:

1. A bag holding and storage apparatus for retaining a recyclable or disposable handle bag, said apparatus comprising:

a receptacle shaped and configured to store a plurality of said bags, said receptacle having spaced first and second ends, spaced front and back sides and an open top portion;

a cover over said open top portion, said cover having selectively open and closed positions;

a first side arm member having a top surface, said member being rotatably connected at said first end of said receptacle and capable of extending forwardly from said front side when in a receiving position and extending downwardly when in a stored position;

a second side arm member having a top surface, said member being rotatably connected at said second end of said receptacle and capable of extending forwardly from said front side when in a receiving position and extending downwardly when in a stored position; and bag handle engaging means on said top surface of each said side arm member, said bag handle engaging means being adapted to positively retain the handle of the bag in a manner holding the bag open for receipt of refuse.

2. The apparatus recited in claim 1, wherein said receptacle is formed with means for mounting to an external structure.

3. The apparatus recited in claim 1, wherein said receptacle is formed with an opening for removing individual said bags therefrom.

4. The apparatus recited in claim 1, wherein said bag handle engaging means comprise upwardly projecting hooks, each of said hooks formed with a slot therein for receiving the bag handle.

5. The apparatus recited in claim 4, wherein said slots further comprise semi-spherical bumps or ridges inside said slot to further aid in positively engaging said handle.

6. The apparatus recited in claim 5, wherein the top surface of each said side arm member contains at least two of said hooks.

7. The apparatus recited in claim 1, wherein said side arm members are rotatable through approximately 90 degrees.

8. The apparatus recited in claim 7, wherein said side arm members are rotatable between an approximately horizontal position and an approximately vertical position.

9. The apparatus recited in claim 1, further comprising securing means located on said first and second ends of said receptacle for securing said first side arm and said second side arm, respectively, in the receiving position.

10. The apparatus recited in claim 9, wherein the securing means further comprises a locking tab means.

11. The apparatus recited in claim 10, wherein the locking tab means comprises a tab and a bulbous body portion that, when in an engaged position, prevents rotation of the side arm, and when in an disengaged position, allows rotation of the side arm.

12. A bag holding and storage apparatus for retaining a recyclable or disposable handle bag, said apparatus comprising:

a receptacle shaped and configured to store a plurality of said bags, said receptacle having first, second ends and front and back sides and an open top portion, said receptacle being formed with means for mounting said back side to external structure;

a cover over said open top portion, said cover having selectively open and closed positions;

a first side arm member having a top surface, said member being rotatably connected at said first end of said receptacle and capable of extending forwardly from said front side when in a receiving position and extending downwardly when in a stored position;

a second side arm member having a top surface, said member being rotatably connected at said second end of said receptacle and capable of extending forwardly from said front side when in a receiving position and extending downwardly when in a stored position;

locking means located on said first and second ends of said receptacle for locking said first side arm and said second side arm, respectively, in the receiving position; and spaced handle engaging means located on said top surface of each said side arm member forming a central section therebetween, said engaging means being adapted to positively retain the handle of the bag when the handle is looped between said engaging means, the bag thereby being positively retained open for receipt of refuse.

13. The apparatus recited in claim 12, wherein said spaced handle engaging means further comprise upwardly projecting hooks.

14. The apparatus recited in claim 13, wherein each of said hooks formed with a slot therein for receiving the bag handle.

15. The apparatus recited in claim 14, wherein said slots further comprise semi-spherical bumps or ridges inside said slots to further aid in positively engaging said handle.

16. The apparatus recited in claim 15, wherein the top surface of each said side arm member contains at least two of said hooks.

17. The apparatus recited in claim 12, wherein said side arm members are rotatable through approximately 90 degrees.

18. The apparatus recited in claim 17, wherein said side arm members are rotatable between an approximately horizontal position and an approximately vertical position.

19. The apparatus recited in claim 12, wherein the locking means further comprises a locking tab means.

20. The apparatus recited in claim 19, wherein the locking tab means comprises a tab and a bulbous body portion that, when in an engaged position, prevents rotation of the side arm, and when in an disengaged position, allows rotation of the side arm.

21. A bag holding and storage apparatus for retaining a recyclable or disposable handle bag, said apparatus comprising:

a receptacle shaped and configured to store a plurality of said bags, said receptacle having first, second ends and front and back sides and an open top portion, said receptacle being formed with means for mounting said back side to external structure;

a first side arm member having a top surface, said member being rotatably connected at said first end of said receptacle and capable of extending forwardly from said front side when in a receiving position and extending downwardly when in a stored position;

a second side arm member having a top surface, said member being rotatably connected at said second end of said receptacle and capable of extending forwardly from said front side when in a receiving position and extending downwardly when in a stored position;

locking means located on said first and second ends of said receptacle for locking said first side arm and said second side arm, respectively, in the receiving position; and upwardly projecting hooks located on said top surface of each said side arm member forming a central section therebetween, said hooks being adapted to positively retain the handle of the bag when the handle is looped between said hooks, the bag thereby being positively retained open for receipt of refuse.

22. The apparatus recited in claim 21, wherein each of said hooks formed with a slot therein for receiving the bag handle.

23. The apparatus recited in claim 22, wherein said slots further comprise semi-spherical bumps or ridges inside said slots to further aid in positively engaging said handle.

24. The apparatus recited in claim 23, wherein the top surface of each said side arm member contains at least two of said hooks.

* * * * *